United States Patent [19]

Kunst et al.

[11] 4,055,446

[45] Oct. 25, 1977

[54] SALT BATH QUENCHING OF CONSTRUCTION PARTS TREATED WITH A NITRIDING BATH

[75] Inventors: Helmut Kunst; Christian Scondo, both of Hanau, Germany

[73] Assignee: Deutsche Gold- und Silber-Scheideanstalt vormals Roessler, Frankfurt, Germany

[21] Appl. No.: 670,154

[22] Filed: Mar. 25, 1976

[30] Foreign Application Priority Data

Apr. 2, 1975 Germany ..... 2514398

[51] Int. Cl.[2] ..... C21D 1/48

[52] U.S. Cl. ..... 148/15; 148/15.5; 148/20; 148/27

[58] Field of Search ..... 148/15.5, 20, 27, 16.6, 148/15

[56] References Cited

U.S. PATENT DOCUMENTS

| | | | |
|---|---|---|---|
| 1,975,058 | 9/1934 | Bennett | 148/15.5 |
| 2,174,867 | 10/1939 | Bellis | 148/15.5 |
| 3,022,204 | 2/1962 | Muller et al. | 148/15.5 |

OTHER PUBLICATIONS

Lyman, T. (Ed.) et al.; Metals Handbook, vol. 2, (Heat-Treating); Cleveland (ASM) 1964, pp. 142 and 356.

Lexin, et al., Phase Diagrams, [Na(K)OH-(K,Na)$NO_3$], Cleveland, 1962, pp. 325 and 326.

*Primary Examiner*—Walter R. Satterfield

*Attorney, Agent, or Firm*—Cushman, Darby & Cushman

[57] ABSTRACT

Iron and steel construction parts which have been treated in a high cyanate, low cyanide or cyanide free nitriding salt bath or in other cyanide containing salt baths are tempered in a bath comprising an alkali metal hydroxide. There also can be present in the cooling bath 2 to 20 weight % of an alkali nitrate.

12 Claims, No Drawings

SALT BATH QUENCHING OF CONSTRUCTION PARTS TREATED WITH A NITRIDING BATH

The invention concerns a bath, e.g., a salt bath for tempering construction parts made of iron and steel which are treated in cyanide free or low cyanide nitriding salt baths or in other cyanide containing salt baths.

For the quenching of construction parts of steel and iron which are heated in salt baths or gas atmospheres to austenitizing temperature there have been used salt baths which are operated at temperatures of about 200° C. Salt baths for this purpose (heat baths) generally consist of alkali metal nitrates or nitrites. The essential advantage of this method of quenching is a strong reduction of the deformation connected with the tempering.

This process is also useful if the construction part is previously treated in cyanide containing salt baths, e.g., in carburization. The cyanide containing salt which remains adhered to the surface of the construction part and is dragged into the heat bath is thereby destroyed by oxidation so that the subsequently used wash waters are cyanide free. The cyanide content of the salt baths used for austenitization or carburization is thereby limited to about 10 weight % (calculated as NaCN) since at higher cyanide contents extraordinarily violent reactions can occur between the cyanide containing salt and the nitrate-nitrite containing salt heat bath.

This limitation of the cyanide content leads to the result that it was not possible to use nitrate-nitrite containing salt melts for quenching the parts treated by salt bath nitriding because the cyanide content in these nitriding baths with concentrations between 40 and 50% NaCN is much too high.

Besides because of the recent development of nitriding salt baths whose cyanide content can range from 0% to 3% or a maximum of 5% calculated as NaCN suggests the possibility that construction parts could be quenched from baths of such composition in known nitrate-nitrite containing salt baths without the fear of a violent reaction, see Beyer German Offenlegungsschrift 2310815 which is hereby incorporated by reference as permitted by *Carnegie Steel Co. v. Cambria Iron Co.*, 46 L.Ed. 968 (Sup. Ct.) and the related Beyer U.S. application No. 448,065 filed Mar. 4, 1974, and now abandoned the entire disclosure of which is hereby incorporated by reference and relied upon. Corresponding experiments, however, showed that this possibility has not come true for two reasons. First, there occurs a still not clarified reaction with certain construction parts in which there is carried over into the heat bath a very large sediment of nitriding bath because of their form. This reaction is so violent that in practice use of this process is eliminated. Besides the cyanide constituent is not completely destroyed. This may be because in the quenching from austenitization or carburization temperature (e.g., 900° C.) the workpiece goes into the quenching bath with a substantially higher temperature and therefore the first prevails a very high reaction temperature at the boundary areas of the construction partheat bath which lead to the decomposition of the cyanide. In the quenching from a nitriding bath (e.g., 580° C.) this boundary area temperature is substantially lower so that a complete destruction of the cyanide does not occur.

It was the problem of the present invention to find a salt bath (or similar bath) which is in the position to completely decompose the cyanide entrained with the construction parts from a nitriding bath and possibly also to completely destroy the cyanate portion, and whose quenching intensity is so high that it does not result in a loss of fatique limit of the construction part. Therewith there is also the possibility to very substantially avoid the deformation of the construction part normally occurring in quenching in salt water.

This problem was solved according to the invention by using a "salt bath" for cooling of the construction parts which comprises or consists of hydroxides of the alkali metals, e.g., sodium hydroxide, potassium hydroxide or lithium hydroxide. Preferably there is used a mixture of sodium hydroxide and potassium hydroxide. While the sodium hydroxide and potassium hydroxide can be mixed in any range preferably there is used 35 to 39% by weight of sodium hydroxide based on the total of sodium hydroxide and potassium hydroxide.

It is also advantageous to replace a portion of the alkali hydroxide portion of the bath by an alkali nitrate, preferably 2–20% of the nitrate based on the entire weight of the bath. As the nitrate there can be used, for example, sodium nitrate, potassium nitrate or lithium nitrate. Mixtures of the nitrates can also be used. In this salt bath the reaction for the destruction of the cyanide and cyanide residue goes especially quickly.

The advantages of the "salt baths" of the invention are explained further in the following examples. In all of the examples quenching was carried out from a nitriding salt operating at a temperature of 570° to 580° C. with a cyanate content ($CNO^-$) of 35 to 38 weight % and a cyanide content ($CN^-$) of 0.9 to 2.5 weight % with the balance being carbonate. The bath contained a mixture of sodium and potassium cyanates, sodium and potassium carbonates and sodium and potassium cyanides. The $K^+$ : $Na^+$ proportion of these compounds being 80 : 20. In place of these baths there can be employed the nitriding and carburiding baths in Examples 1–9 of the Beyer et al U.S. application set forth above with the heat bath of Examples 1 and 2 below. The nitriding baths in Beyer et al in particular are preferably employed.

From the baths mentioned in the preceding paragraph, there were carried over in each case the stated amount of salt with the treated steel parts into the heat bath.

Unless otherwise indicated all parts and percentages are by weight.

EXAMPLE 1

Example 1

| Composition of the Heat Bath of the Invention: | |
|---|---|
| Sodium hydroxide | 41.6 weight % |
| Potassium hydroxide | 58.4 weight % |
| Temperature of the Heat Bath: | 200° C. |
| Entrained Amount of Salt: | 15% of the heat bath content |

Results:

There was measured in the heat bath a cyanide content of 0 weight % and a cyanate content which likewise was 0 weight %. The treated construction parts also no longer had cyanide and cyanate residues adhering thereto. As construction parts there were employed crankshafts 750 mm long and 60 mm in diameter. The concentricity error of the thus treated crankshafts was less than 0.1 mm while with the usual quenching in salt water allowance must be made for concentricity errors of about 0.3 mm. The fatigue limit of the thus treated crankshafts was not lowered in comparison to quenching in salt water.

EXAMPLE 2

Composition of the heat bath of the invention:

Example 2

| Compositon of the heat bath of the Invention: | |
|---|---|
| Sodium hydroxide | 37.4 weight % |
| Potassium hydroxide | 52.6 weight % |
| Sodium nitrate | 10.0 weight % |
| Temperature of the Heat Bath: | 220° C. |
| Entrained Amount of Salt: | 17% of the heat bath content |

Results: The same as in Example 1.

EXAMPLE 3

Composition of the heat bath of the invention:

Example 3

| Composition of the heat bath of the Invention: | |
|---|---|
| Sodium hydroxide | 37.4 weight % |
| Potassium hydroxide | 52.6 weight % |
| Sodium nitrate | 10.0 weight % |
| Temperature of the Heat Bath | 230° C. |
| Entrained Amount of Carburizing Salt: | 12% of the heat bath content. |

Results:

The same as in Examples 1 and 2. Ball bearing cases were carburized in a salt bath containing 10 – 12% NaCN, 34 – 36% $BaCl_2$ and $Na_2Co_3$. The treating time was 60 minutes at 930° C. The parts were quenched in the heat bath. After quenching 150 loads (each load 33 kg ≙ 72.8 lbs) no cyanide or cyanate could be detected by chemical analysis of the quench bath. Therefore no detoxification of the waste waters was necessary before conducting it to a normal sewage. The carburized and quenched parts showed a minimum distortion which did not exceed such produced by quenching in a nitrate-nitrite containing heat bath. The heat baths of the invention are preferably operated at temperatures of 200°–300° C. but there can be used higher temperatures up to 580° C. The lowest practical temperature for the heat bath is 190° C. The deformation of the construction part is so considerably reduced by the quenching in the heat bath that in industrial use of this process that there can be eliminated an adjustment procedure. A further substantial advantage of the heat baths ("salt baths") of the invention is that the working up of the wash waters can be limited to a neutralization while in using the known nitrate-nitrate containing salt bath a detoxification is necessary before the waste waters are allowed to be conducted to a normal sewage. This has given occasion to the consideration of using the heat baths ("salt baths") of the invention also for quenching carburized construction parts. As numerous tests have shown, this process is directly usable to quench construction parts which come from salt baths containing up to 25 weight % cyanide (calculated as $CN^-$). Also in this case, the cyanide portion is broken down without residue and the deformation is reduced in the same manner as it can be by tempering in nitrate-nitrite containing heat baths. There is also not needed in this case a detoxification of the wash waters but merely a neutralization.

The heat baths of the invention can consist essentially of or consist of the materials set forth and the process can comprise, consist essentially of or consist of the steps set forth.

What is claimed is:

1. In a process of tempering an iron or steel part that has been treated initially in (1) a low cyanide, high cyanate nitriding bath, (2) a cyanide free, high cyanate nitriding bath or (3) a high cyanide nitriding or carburiding bath, the improvement comprising taking the part containing entrained cyanide or cyanate from said bath and placing it in a tempering bath having a temperature of 190° to 580° C and keeping the part in the tempering bath until the entrained cyanide or cyanate is substantially completely decomposed, said bath consisting of at least one alkali metal hydroxide with 2 to 20% of at least one alkali metal nitrate based on the total weight of the tempering bath.

2. A process according to claim 1 wherein the tempering is carried out at 200° to 580° C.

3. A process according to claim 2 wherein the tempering bath is a mixture of sodium hydroxide, potassium hydroxide and sodium nitrate.

4. A process according to claim 2 wherein the tempering is carried out at a temperature between 200° and 300° C.

5. A process according to claim 1 wherein the initial bath is (1).

6. A process according to claim 1 wherein the initial bath is (2).

7. A process according to claim 1 wherein the initial bath has up to 25% cyanide.

8. A process according to claim 7 wherein the initial bath is (1) and has a cyanide content of not over 5%.

9. A process according to claim 8 wherein the initial bath has not over 3% cyanide.

10. A process according to claim 9 wherein the cyanide content of the initial bath is 0.9 to 2.5%.

11. A process according to claim 1 wherein the alkali metal of the hydroxide and the nitrate is selected from the group consisting of sodium and potassium.

12. A process according to claim 11 wherein the nitrate is 10%.

* * * * *